US010858980B2

(12) United States Patent
Biller et al.

(10) Patent No.: US 10,858,980 B2
(45) Date of Patent: Dec. 8, 2020

(54) COOLING SYSTEM FOR AN INTERNAL COMBUSTION ENGINE

(71) Applicant: AVL LIST GMBH, Graz (AT)

(72) Inventors: Reinhard Biller, Graz (AT); Christof Knollmayr, Graz (AT); Gernot Fuckar, Graz (AT)

(73) Assignee: AVL LIST GMBH, Graz (AT)

( * ) Notice: Subject to any disclaimer, the term of this patent is extended or adjusted under 35 U.S.C. 154(b) by 117 days.

(21) Appl. No.: 15/022,128

(22) PCT Filed: Sep. 15, 2014

(86) PCT No.: PCT/EP2014/069576
§ 371 (c)(1),
(2) Date: Mar. 15, 2016

(87) PCT Pub. No.: WO2015/036584
PCT Pub. Date: Mar. 19, 2015

(65) Prior Publication Data

US 2016/0230639 A1 Aug. 11, 2016

(30) Foreign Application Priority Data

Sep. 16, 2013 (AT) ..... 50587/2013

(51) Int. Cl.
*F02F 1/36* (2006.01)
*F01P 3/02* (2006.01)
(Continued)

(52) U.S. Cl.
CPC ..... *F01P 3/02* (2013.01); *F01P 11/16* (2013.01); *F02F 1/10* (2013.01); *F02F 1/40* (2013.01);
(Continued)

(58) Field of Classification Search
CPC ..... F01P 2003/027; F01P 3/02; F01P 7/16; F02F 1/40
(Continued)

(56) References Cited

U.S. PATENT DOCUMENTS 5,031,579 A * 7/1991 Evans ..... F01P 3/2207 123/41.2
5,419,287 A * 5/1995 Evans ..... F01P 3/20 123/41.01
(Continued)

FOREIGN PATENT DOCUMENTS

DE 10212672 10/2003
DE 102009023530 12/2010
(Continued)

OTHER PUBLICATIONS

English Abstract of EP 2562379.
(Continued)

*Primary Examiner* — Long T Tran
*Assistant Examiner* — James J Kim
(74) *Attorney, Agent, or Firm* — Dykema Gossett PLLC

(57) ABSTRACT

The invention relates to a cooling system (4) for an internal combustion engine having at least one cylinder head (1), the at least one cylinder head being connected to at least one cylinder block (2) by means of a cylinder-bead sealing surface (28). The cooling system comprises at least one first cooling jacket (5) arranged in the cylinder head (1), the at least one first cooling jacket having a flow connection to at least one coolant inlet (27) and at least one first coolant outlet (19), and at least one second cooling jacket (6) arranged in the cylinder block (2), the at least one second cooling jacket being connected to at least one second coolant outlet (20) in the cylinder head (1), wherein the first cooling jacket (5) and the second cooling jacket (6) are connected to
(Continued)

each other by means of at least one connection flow path (17), which preferably extends through an opening (17*a*) in the cylinder-bead sealing surface (28), and a liquid coolant can flow through the first cooling jacket and the second cooling jacket in succession, and wherein the coolant flow through the second cooling jacket (6) can be controlled by means of at least one first valve (8), preferably a thermostat valve, which blocks the coolant flow through the second cooling jacket (6) in a first valve position and allows the coolant flow through the second cooling jacket in at least one second valve position. In order to enable quick heating of the coolant while achieving optimal cooling of the internal combustion engine, flow through the first cooling jacket (5) according to the invention is possible in a transverse direction of the internal combustion engine.

19 Claims, 10 Drawing Sheets

(51) Int. Cl.
*F02F 1/40* (2006.01)
*F02F 1/10* (2006.01)
*F01P 11/16* (2006.01)

(52) U.S. Cl.
CPC ... *F01P 2003/024* (2013.01); *F01P 2003/028* (2013.01)

(58) Field of Classification Search
USPC ..... 123/41.82 R
See application file for complete search history.

(56) References Cited

U.S. PATENT DOCUMENTS 6,202,603 B1 * 3/2001 Etemad ..... F01P 3/02 123/41.31
6,732,679 B2 5/2004 Iizuka
6,758,171 B2 * 7/2004 Hwang ..... F01P 7/165 123/41.05
6,799,540 B2 * 10/2004 Akiwa ..... F02B 75/22 123/41.82 R
7,055,467 B2 * 6/2006 Yi ..... F01P 3/02 123/41.29
7,086,355 B2 * 8/2006 Yamamoto ..... F01P 3/02 123/41.72
7,207,298 B2 * 4/2007 Lee ..... F01P 7/165 123/41.05
7,225,766 B2 * 6/2007 Zahdeh ..... F02F 1/108 123/41.79
7,334,545 B2 * 2/2008 Muller ..... F01P 3/02 123/41.08
7,980,206 B2 * 7/2011 Nagafuchi ..... F02F 1/243 123/193.5
8,863,704 B2 * 10/2014 Mehring ..... F02F 1/10 123/41.16
9,243,545 B2 * 1/2016 Quix ..... F01P 7/14
9,581,072 B2 * 2/2017 Hutchins ..... F01P 7/16
2008/0314339 A1 12/2008 Koseki
2010/0089343 A1 4/2010 Hamada
2010/0162974 A1 * 7/2010 Yamanishi ..... F01P 5/10 123/41.47
2011/0214627 A1 * 9/2011 Nishikawa ..... F01P 7/164 123/41.02
2011/0259287 A1 * 10/2011 Kakehashi ..... F01P 7/164 123/41.09
2012/0227687 A1 9/2012 Galeazzi et al.
2012/0240884 A1 * 9/2012 Zahdeh ..... F02F 1/40 123/41.79
2013/0160723 A1 * 6/2013 Miyagawa ..... F01P 7/16 123/41.1
2014/0196674 A1 * 7/2014 Quix ..... F01P 7/14 123/41.09
2014/0290600 A1 * 10/2014 Lee ..... F01P 3/02 123/41.29

FOREIGN PATENT DOCUMENTS

| | | |
|---|---|---|
| DE | 202013100500 | 4/2013 |
| EP | 2562379 | 2/2013 |
| FR | 2934319 | 1/2010 |
| GB | 2348485 | 10/2000 |
| JP | 2009216063 | 9/2009 |
| KR | 20090102191 | 9/2009 |

OTHER PUBLICATIONS

English Abstract of FR 2934319.
English Abstract of DE 102009023530.
English Abstract of DE 10212672.
English Abstract of JP 2009216063.
English Abstract of KR 20090102191.

* cited by examiner

Fig.10a
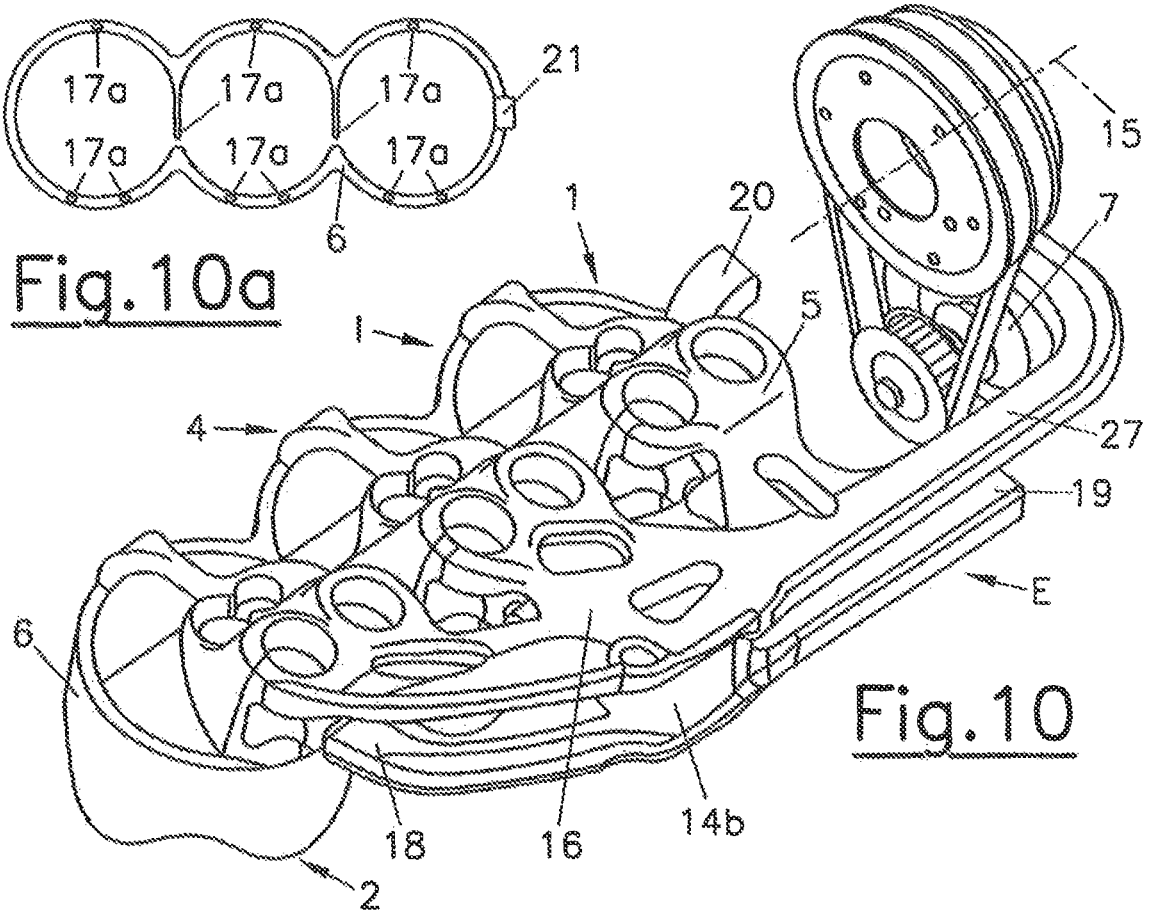
Fig.10
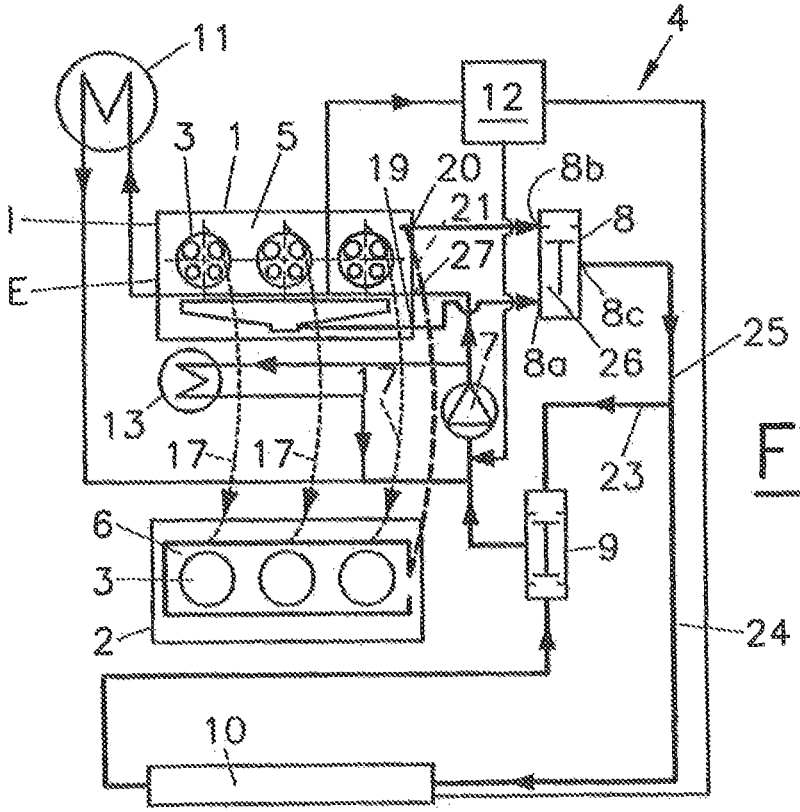
Fig.11

COOLING SYSTEM FOR AN INTERNAL COMBUSTION ENGINE

BACKGROUND OF THE INVENTION

Field of the Invention

The invention relates to a cooling system for an internal combustion engine, which includes at least one cylinder head connected to at least one cylinder block by means of at least one cylinder-head sealing surface, at least one first cooling jacket arranged in the cylinder head having a flow connection with at least one coolant inlet and at least one first coolant outlet, and at least one second cooling jacket arranged in the cylinder block which is connected to at least one second coolant outlet, wherein the first and the second cooling jackets are connected to each other by at least one connection flow path which preferably extends through an opening in the cylinder-head sealing surface, and wherein a liquid coolant can flow through the first cooling jacket and the second cooling jacket in succession, and wherein the coolant flow through the second cooling jacket can be controlled by at least one first valve, preferably a thermostat valve, which blocks the coolant flow through the second cooling jacket in a first valve position and allows coolant flow in at least one second valve position.

The Prior Art

An internal combustion engine with a cylinder head and a cylinder block is known from GB 2 348 485 A, wherein the cylinder head and the cylinder block each comprise a cooling jacket. The cooling jacket of the cylinder block is in flow connection with the cooling jacket of the cylinder head/wherein coolant enters the cooling jacket of the cylinder head and flows from the cooling jacket of the cylinder head to the cooling jacket of the cylinder block.

EP 1 258 609 A2 discloses a similar water-cooled internal combustion engine with a cooling jacket in the cylinder head and a cooling jacket in the cylinder block, wherein the coolant only flows through the cooling jacket of the cylinder head in the cold state and is additionally also conducted in the hot state through the cooling jacket of the cylinder block and a radiator connected downstream of the cylinder block. The coolant from the cooling jacket of the cylinder head flows directly into the return line leading to the coolant pump.

The coolant inlet and coolant outlet of the cooling jacket of the cylinder head are situated at different ends of the cylinder head both in GB 2 348 485 A and in EP 1 258 609 A2, by means of which the coolant flows in the longitudinal direction through the cooling jacket of the cylinder head. A relatively large cooling jacket cross-section is thus necessary in the cylinder head. The disadvantage of relatively long heating-up times of the coolant is caused by the necessary relatively large coolant volume.

EP 2 562 379 A1 describes a separate coolant circuit for an internal combustion engine, wherein a cylinder head water jacket and an engine block water jacket are provided. The separate coolant circuit comprises a pump, a cooler, a control element, an outlet housing and a heating, wherein a coolant circulates in the separate coolant circuit. The control element is downstream of the cylinder head water jacket and comprises a thermostat and a proportional valve that is separate therefrom. The coolant can be supplied via the control element either to a cooler or the engine block water jacket. Flow occurs longitudinally both through the cylinder head water jacket also the cylinder block water jacket. Said longitudinal flow as well as a relatively large number of required external lines between the cylinder head water jacket the cylinder block water jacket have a disadvantageous effect on the coolant volume.

It is the object of the invention to avoid these disadvantages and to improve the cooling and heating-up behaviour.

SUMMARY OF THE INVENTION

This is achieved in accordance with the invention in such a way that the flow through the first cooling jacket, and preferably also the second cooling jacket, can occur in a transverse direction of the internal combustion engine, wherein preferably at least one collecting chamber extending substantially in the longitudinal direction of the internal combustion engine is arranged in the flow path between the first cooling jacket and the first coolant outlet and/or a distributor chamber extending substantially in the longitudinal direction of the internal combustion engine is arranged in the flow path between the coolant inlet and the first cooling jacket.

The longitudinal direction of the internal combustion engine shall be understood in this case as a direction parallel to the crankshaft axis. The transverse direction of the internal combustion engine shall be understood as a direction oriented approximately normally to the crankshaft axis and normally to the cylinder axis.

Since the flow occurs through the first cooling jacket in the transverse direction of the internal combustion engine, it is possible to avoid external lines between the first and the second cooling jacket on the one hand and the cross-section of the first cooling jacket, as seen normally to the crankshaft axis, can be kept at a low dimension, as a result of which the coolant volume can be reduced drastically. The second cooling jacket is activated or deactivated as required, wherein the full coolant quantity always flows through the first cooling jacket of the cylinder head. As a result, a sufficient removal of heat from thermally highly loaded regions around the exhaust valves in the fire deck can be ensured in every operating range of the internal combustion engine.

The collecting chamber for the coolant can be integrated in the cylinder block according to a first embodiment of the invention. The collecting chamber is hydraulically separated from the second cooling jacket within the cylinder block. This variant offers the advantage that no constructional measures need to be taken for housing the collecting chamber in the cylinder head, which simplifies the production of the cylinder head.

It is provided in a second embodiment of the invention that the collecting chamber is arranged in the cylinder head, wherein preferably the collecting chamber is arranged between the exhaust ports and the cylinder-head sealing surface. This arrangement offers the advantage that as a result of the collecting chamber integrated in the cylinder head the exhaust ports, and optionally also an exhaust manifold integrated in the cylinder head, can additionally be cooled.

The collecting chamber can substantially extend over the entire length of the cylinder head or cylinder block.

In order to enable an adequate transport of heat from thermally critical regions of the cylinder head in any operating range and rapid heating after cold starting, it is advantageous if the first coolant outlet of the cylinder head has a continuous flow connection with the return line of the cooling system and the second coolant outlet of the cylinder head is switchably connected via the first valve to a return line of the cooling system.

It can be provided in this case that a mixing chamber of the first valve comprises a first and a second valve inlet as well as a valve outlet, and the first coolant outlet of the cylinder head is flow-connected to the first valve inlet, the second coolant outlet to the second valve inlet, and the valve outlet to a return line of the cooling system, wherein only the flow connection between the second valve inlet and the valve outlet is preferably switchable by the first valve.

The return line can comprise a long return section with at least one radiator and a short return section surrounding the radiator, wherein the coolant flow can be controlled by the short or long return section by at least one second valve, preferably a thermostat valve. The coolant can be supplied via the second valve to the coolant pump again, either directly or via a cooler of the coolant pump.

The entire flow flows in all embodiments of the invention through the first cooling jacket. The first valve is arranged downstream of the first cooling jacket, which first valve completely blocks the discharge of the coolant from the second cooling jacket of the cylinder block in a first position. As a result, the entire coolant is supplied directly to the return line of the cooling system. If the first valve moves to the second position, a partial flow of the coolant is conducted to the second cooling jacket of the cylinder block. After flowing through the second cooling jacket, coolant is conducted via a transfer port back to the cylinder head where it is supplied via the first valve to the coolant system.

It can be provided in a further embodiment of the invention that the coolant pump is driven by a camshaft preferably arranged in the cylinder head. This measure offers the advantage that the coolant volume between the coolant pump and the first cooling jacket can be reduced to a minimum, which has an advantageous effect on the heating-up time of the coolant.

An especially low coolant volume and thus very short heating-up times can be achieved when the coolant inlet, the first coolant outlet and the second coolant outlet are arranged in the cylinder head.

BRIEF DESCRIPTION OF THE DRAWINGS

The invention will be explained below in greater detail by reference to the drawings, wherein:

FIG. 10 shows a cooling system in accordance with the invention in a second embodiment in an oblique view;

FIG. 10*a* shows the second cooling jacket in a top view of the cylinder-head sealing plane;

FIG. 11 shows the cooling system in accordance with the invention in a second embodiment in a schematic view;

DETAILED DESCRIPTION OF THE DEPICTED EMBODIMENTS

Figure 1:
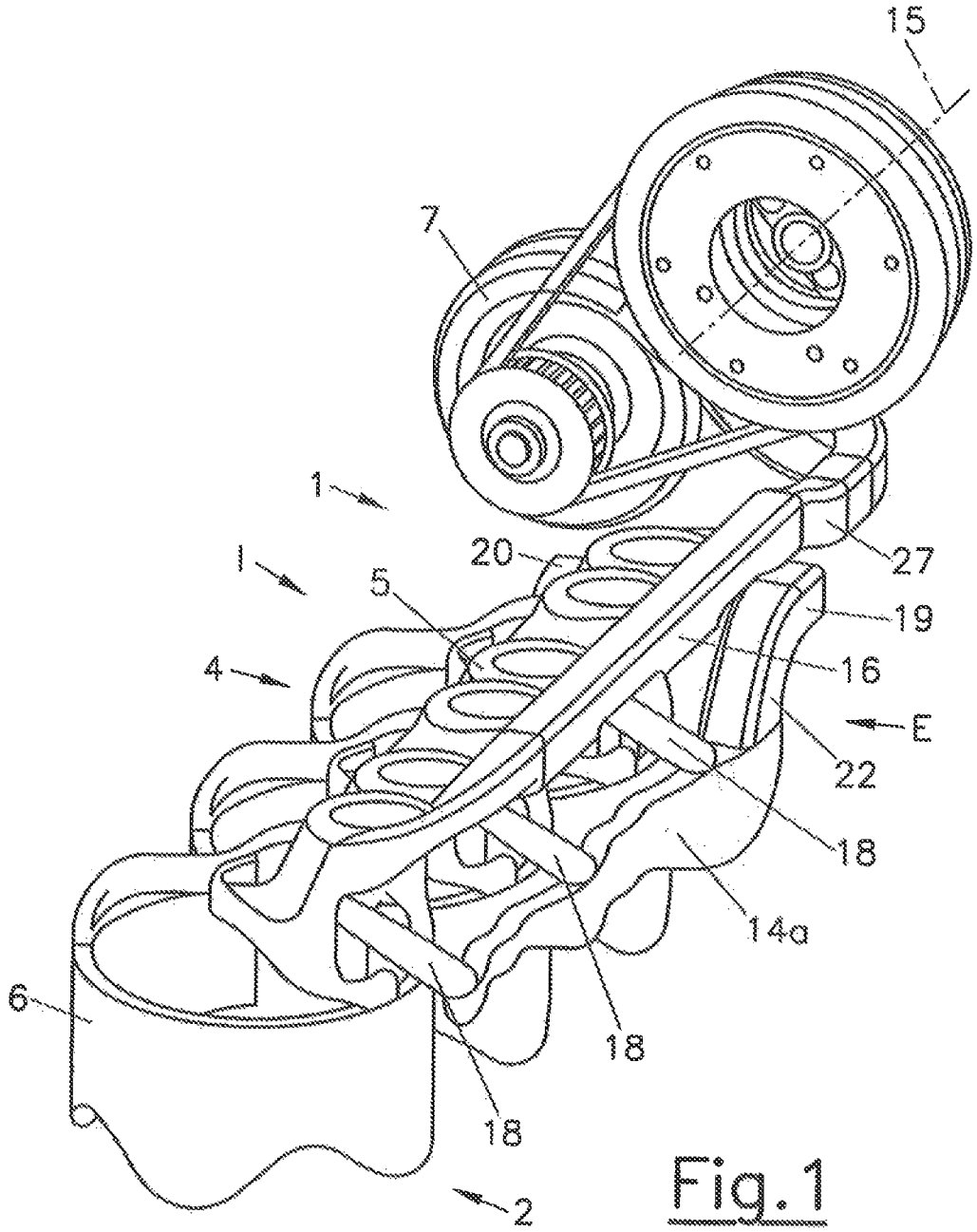
FIG. 1 shows the cooling jackets of a cooling system in accordance with the invention in a first embodiment in an oblique view.

Features with similar functions are shown in the embodiments with the same reference numerals.

Elements without flow of the cooling system 4 are not shown in FIGS. 4, 6, 8 and FIGS. 12, 14, 18 for reasons of clarity of the illustration.

The internal combustion engine comprises a cylinder head 1 and a cylinder block 2 for several respective cylinders 3, as well as a cooling system 4 with a liquid cooling medium. A first cooling 5 is arranged in the cylinder head 1, which is used for cooling thermally critical regions in the cylinder head 1. The cylinder block 2 comprises a second cooling jacket 6, which is flow-connected to the first cooling jacket 5. The cooling jacket 5 is flow-connected to a coolant inlet 27 and a first coolant outlet 19 of the cylinder head 1.

Figure 3:
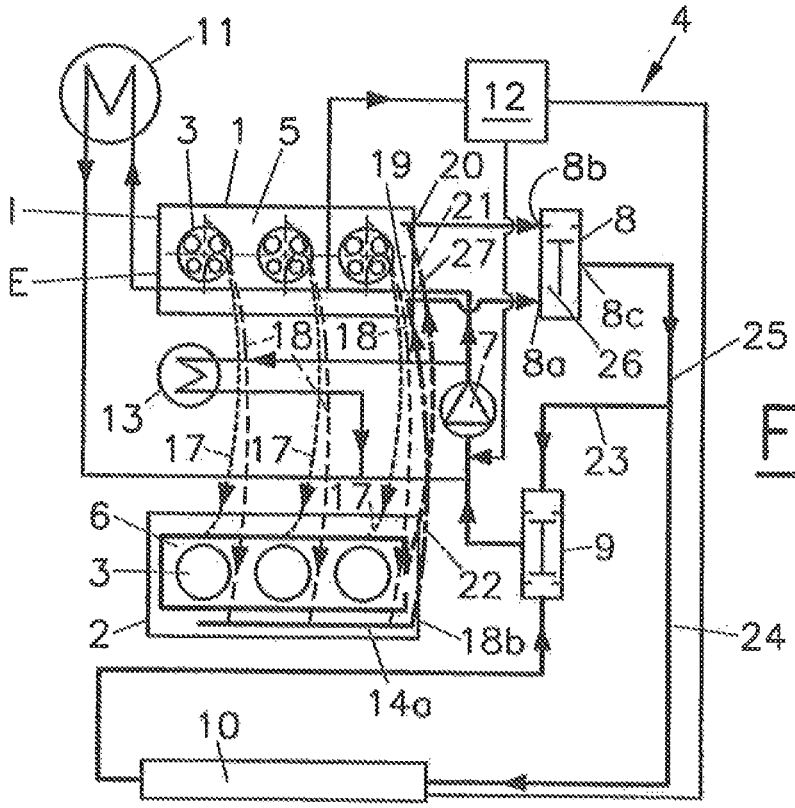
FIG. 3 shows the cooling system in accordance with the invention in a first embodiment in a schematic view.

In addition to the first cooling jacket 5 and the second cooling jacket 6, the cooling system 4 further comprises a coolant pump 7, a first valve 8 arranged as a thermostat valve, a second valve 9 arranged as a thermostat valve, a radiator 10, an interior heating 11, an expansion tank 12 and an oil cooler 13, as shown in FIG. 3 and FIG. 11. The cooling system further comprises a collecting chamber 14*a* or 14*b* extending in the longitudinal direction of the cylinder block 2, which collecting chamber is arranged either in the cylinder block 2 (FIGS. 1 to 9) or in the cylinder head 1 (FIGS. 10 to 17).

The components of coolant pump 7, first thermostat valve 8 and second valve 9 can be combined in a pump-thermostat module. The coolant pump 7 is advantageously arranged in or on the cylinder head 1 and is driven by an overhead camshaft, which is indicated in FIG. 1 by the camshaft axis 15.

Coolant is conducted from the coolant pump 7 via a distributor chamber 16 within the cylinder head 1 to the first coolant jacket 5, said distributor chamber extending in the longitudinal direction of the internal combustion engine. The distributor chamber 16 is arranged in the embodiments on the outlet side E of the cylinder head 1. The inlet side is indicated with reference numeral I. The coolant flows from the distributor chamber 16 in the transverse direction of the cylinder head 1 through the first coolant jacket 5, wherein thermally highly loaded regions around the exhaust valves etc are cooled. The first cooling jacket 5 is in flow connection with the second cooling jacket 6 via openings 17*a* in the cylinder-head sealing surface 28 or in the cylinder head gasket (not shown). The first cooling jacket 5 is further connected to the collecting chamber 14*a* or 14*b* via collecting ports 18, wherein at least one collecting port 18 is provided per cylinder 3. The collecting chamber 14*a*, 14*b* is further connected to a first outlet 19 arranged in the cylinder head 1. Furthermore, the second cooling jacket 6 of the cylinder block 2 is flow-connected via a riser duct 21 to a second outlet 20 in the cylinder head 1.

Figure 1A:
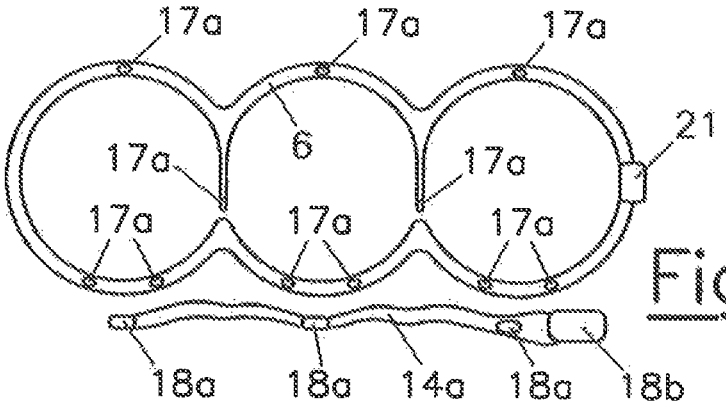
FIG. 1*a* shows the second cooling jacket in a top view of the cylinder-head sealing plane.
Figure 2:
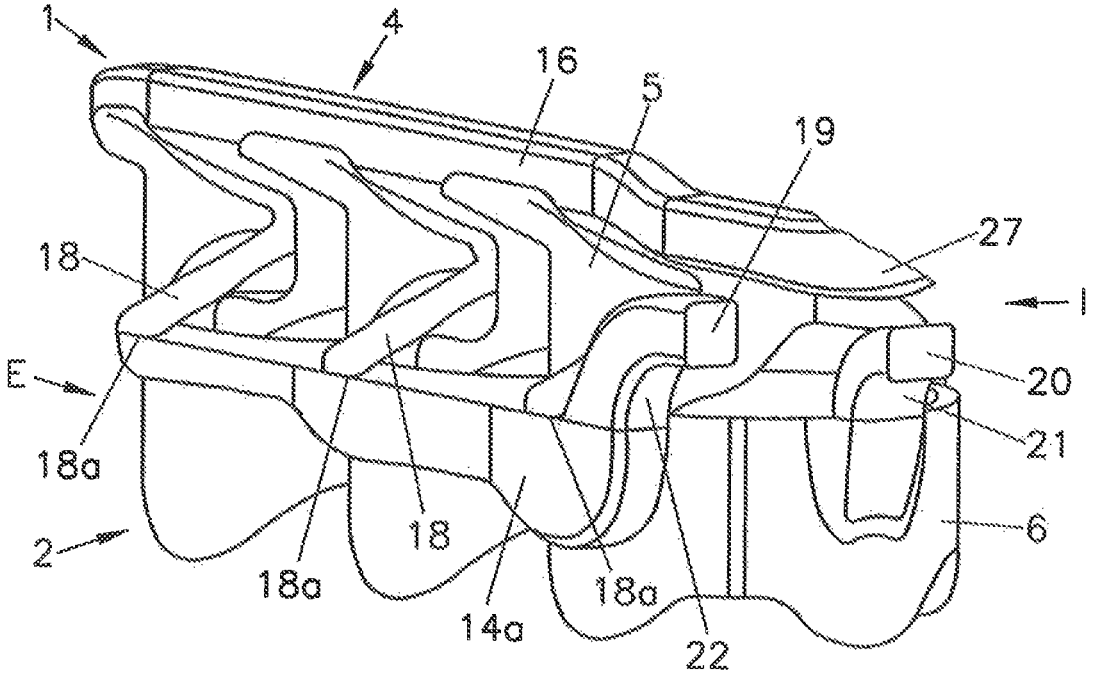
FIG. 2 shows the cooling jackets in a further oblique view.

In the embodiment shown in FIG. 1 to FIG. 9, the cylinder head gasket comprises openings 18*a*, via which the coolant reaches the collecting chamber 14*a* via the collecting ports 18. Furthermore, the cylinder head gasket comprises a transfer opening 18*b* in the region of a face end of the internal combustion engine, by which the coolant passes from the collecting chamber 14*a* in the cylinder block 2 via an outlet port 22 in the cylinder head 1 to the first outlet 19. The openings 17*a*, 18*a* and the transfer opening 18*b* are clearly shown in FIG. 1*a*.

In contrast thereto, the openings 18*a* and the transfer opening 18*b* in the cylinder head gasket can be avoided in the embodiment shown in FIGS. 10 to 17 with a collecting chamber 14*b* integrated in the cylinder head 1. The collecting chamber 14*b* is arranged beneath the exhaust ducts 29, i.e., on the side facing the cylinder block 2, or an exhaust manifold 30 (see FIG. 18) integrated in the cylinder head 1. The exhaust ducts are upwardly bounded by the distributor chamber 16 on the one hand and downwardly by the collecting chamber 14*b* on the other hand, which ensures especially high removal of heat from the region of the exhaust ports (see FIG. 10).

In both embodiments, the first coolant outlet 19 and the second coolant outlet 20 are connected to a first or second valve inlet 8*a*, 8*b* of the first valve 8, wherein a return line 25 leads from the valve outlet 8*c* of the first valve 8 via a short return section 23 or a long return section 24 back to the coolant pump 7. The radiator 10 is arranged in the long return line 24 for cooling the coolant. The path through the short return section 23 or long return section 24 is controlled by the second valve 9. The direction of flow of the coolant is indicated by arrows.

The following applies to both embodiments: The entire coolant flows through the first cooling jacket 5 of the cylinder head 1. A portion of the coolant entering the first cooling jacket 5 flows through the second cooling jacket 6 in the cylinder block 2 via the first valve 8 depending on the temperature of the coolant. The second valve 9 is used to return the coolant either via the radiator 10 or directly, by circumventing the radiator 10, to the coolant pump 7.

The coolant flows are indicated by arrows.

First Embodiment (FIG. 1 to FIG. 9)

Figure 5:
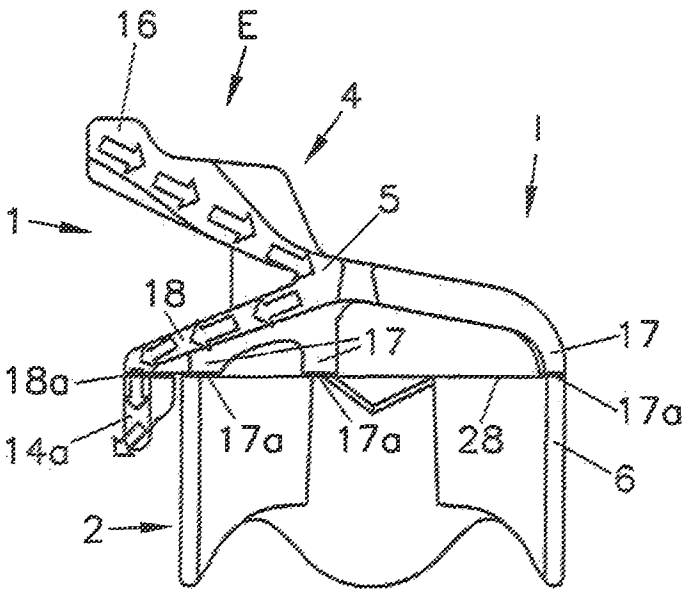
FIG. 5 shows the coolant flow in the first switching position in a cross-sectional view through the cooling jackets.
Figure 4:
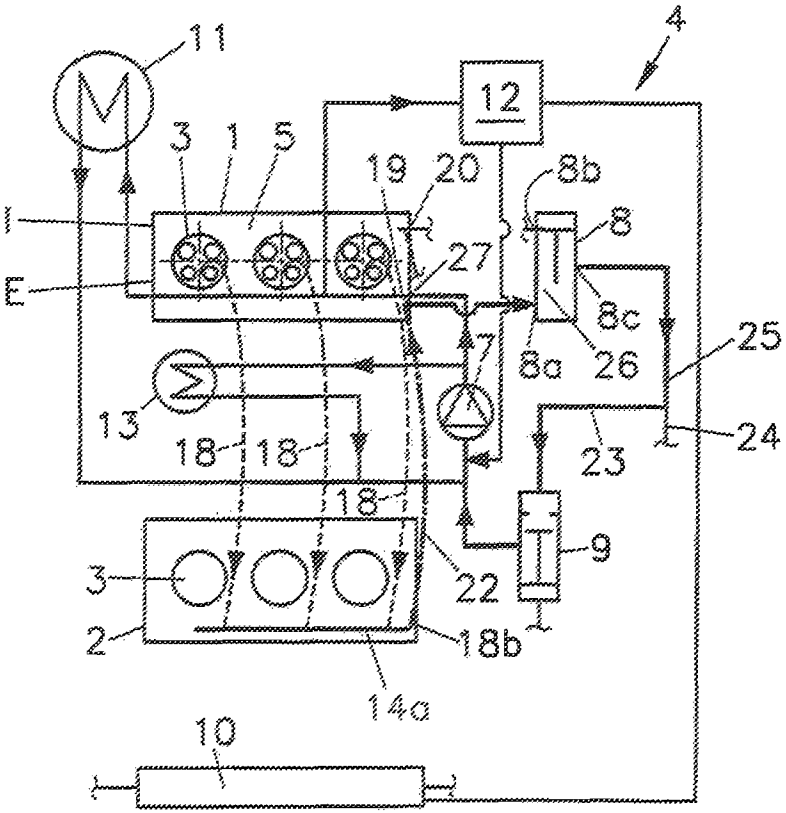
FIG. 4 shows the cooling system of FIG. 3 in a first switching position.

In the first switching position of the cooling system 4 shown in FIG. 4, the first valve 8 and the second valve 9 are in a first valve position, wherein the first switching positions are assigned to the cold state of the coolant. The coolant is conveyed by the first coolant pump 7 to the first cooling jacket 5 of the cylinder head 1. The first coolant outlet 19 is connected to the valve outlet 8*c* of the first thermostat valve 8 in the first valve position of the first valve 8, but the second coolant outlet 20 is separated from the valve outlet 8*c* of the first valve 8. As a result of the blocked discharge from the second cooling jacket 6, the coolant is unable to transfer from the first cooling jacket 5 to the second cooling jacket 6, as a result of which the coolant only flows through the first cooling jacket 5 in the cylinder head 1. The entire coolant moves from the first cooling jacket 5 via the collecting ports 18 to the collecting chamber 14*a* arranged in the cylinder block 2 and flows from the collecting chamber 14*a* via the transfer opening 18*b* and the outlet port 22 to the first coolant outlet 19 of the cylinder head 1 and further to the first valve inlet 8*a* of the first valve 8. The second valve 9 is situated in the first valve position shown in FIG. 4, through which the coolant discharge from the radiator 10 is closed. The coolant thus passes from the first valve 8 directly back to the coolant pump 7. FIG. 5 shows the flow between the distributor chamber 16 and the collecting chamber 14*a* for this first switching position of the cooling system 4.

Figure 7:
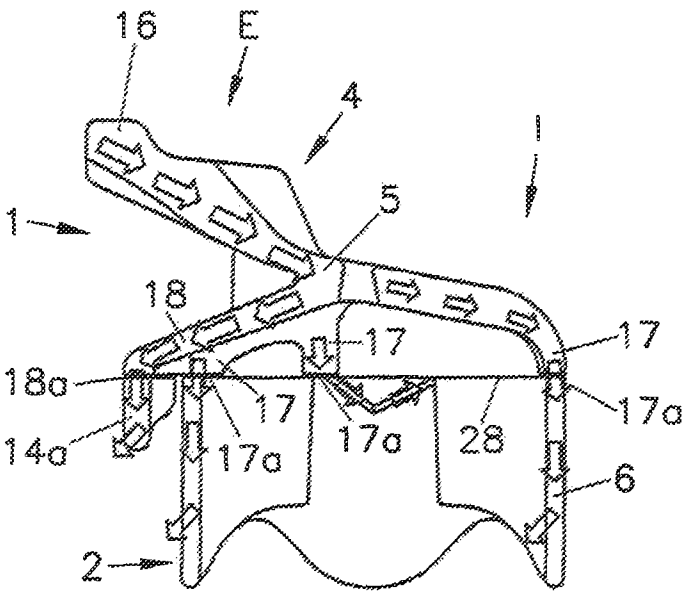
FIG. 7 shows the coolant flow in the second switching position in a cross-sectional view through the cooling jackets.
Figure 6:
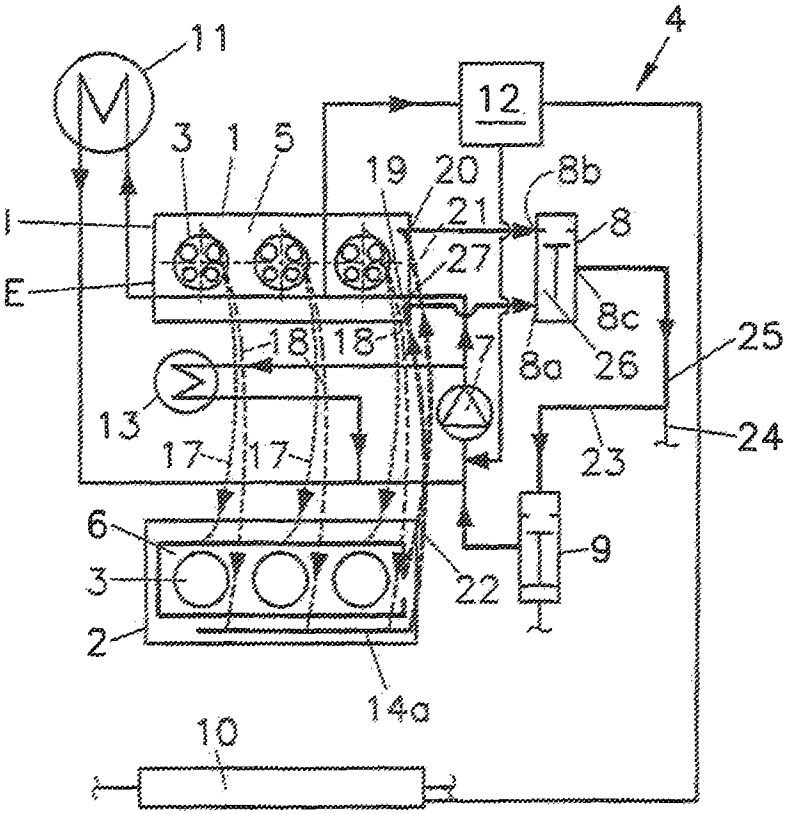
FIG. 6 shows the cooling system of FIG. 3 in a second switching position.

FIG. 6 shows the cooling system 4 when the internal combustion engine is hot, wherein the first valve 8 is in the second valve position and the second valve 9 is still in the first valve position. The second valve position, of the first valve 8 is assigned to hot or cold coolant temperatures. In the second valve position of the first valve 8, both the first valve inlet 8*a* and also the second valve inlet 8*b* are flow-connected to the valve outlet 8*c*. This releases, the discharge from the second valve outlet 20 and thus from the second cooling jacket 6 of the cylinder block 2. The coolant now flows via the collecting ports 18 to the collecting chamber 14*a*, and also via the connecting flow paths 17 and the openings 17*a* of the cylinder-head sealing surface 28 or the cylinder head gasket to the second cooling jacket 6 arranged in the second cylinder block 2. The coolant reaches the second outlet 20 of the cylinder head 1 from the second cooling jacket 6 via the rise duct 21. The merging of the partial flow flowing through the first cooling jacket 5 and the second cooling jacket 6 occurs in a mixing chamber 26 of the valve 8 within the first valve 8. The coolant is conducted directly back to the coolant pump 7 via the valve 9 situated in the first valve position. FIG. 7 shows the flow between the distributor chamber 16 and the second cooling jacket 6 or collecting chamber 14*a* for this second switching position of the cooling system 4.

Figure 9:
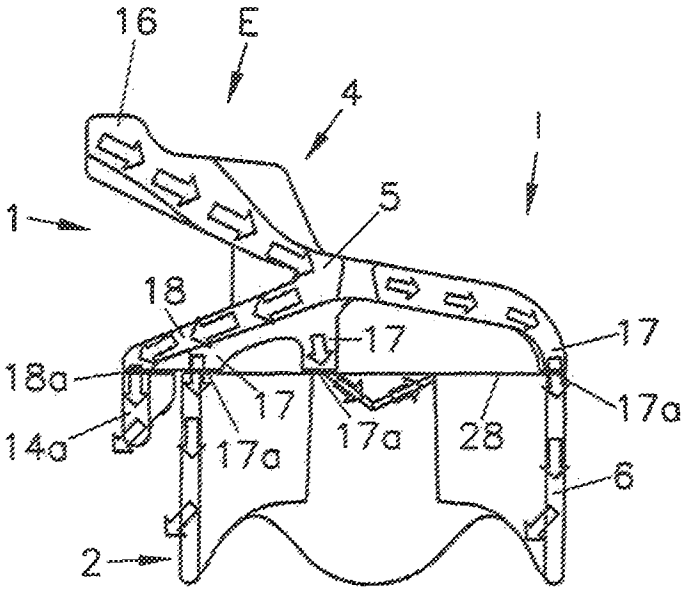
FIG. 9 shows the coolant flow in the third switching position in a cross-sectional view through the cooling jackets.
Figure 8:
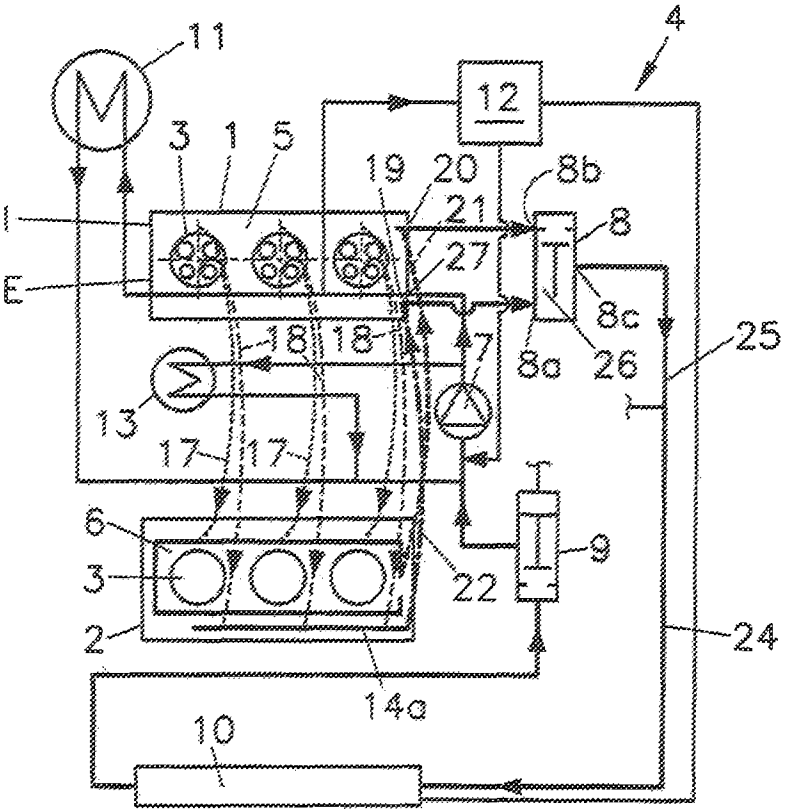
FIG. 8 shows the cooling system of FIG. 3 in a third switching position.

If the temperature of the internal combustion engine and thus the temperature of the coolant increases further, the second valve 9 switches to the second valve position, as shown in FIG. 8. The discharge from the radiator 10 to the coolant pump 7 is released in this second valve position, as a result of which the coolant flows through the long return section 24 and the radiator 10. The flow through the first and the second cooling jacket 5, 6 occurs similar to FIG. 6 and FIG. 7, as shown in FIG. 9.

Second Embodiment (FIG. 10 to FIG. 17)

This embodiment differs from the first embodiment shown in FIG. 1 to FIG. 9 in such a way that the collecting chamber 14*b* is now not arranged in the cylinder block 2 but in the cylinder head 1. This offers the advantage that the coolant volume can be reduced further and the cylinder block 2 can be arranged with a simpler configuration. As is shown in FIG. 10*a*, substantially fewer openings 17*a* are required in the cylinder-head sealing surface 28.

Figure 13:
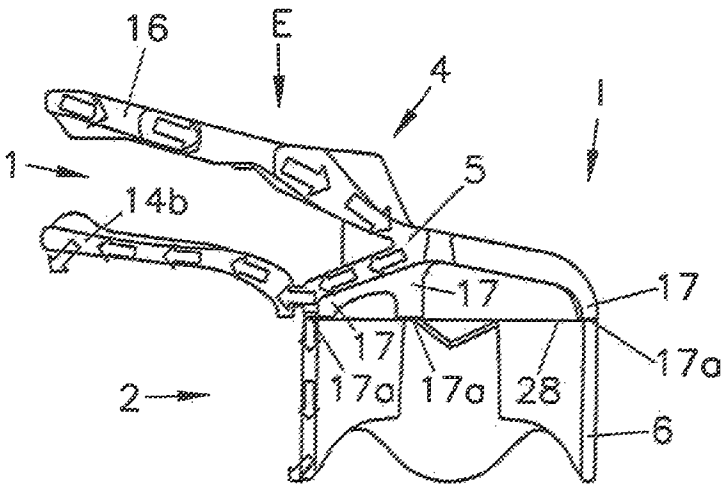
FIG. 13 shows the coolant flow in the first switching position in a cross-sectional view through the cooling jackets.
Figure 12:
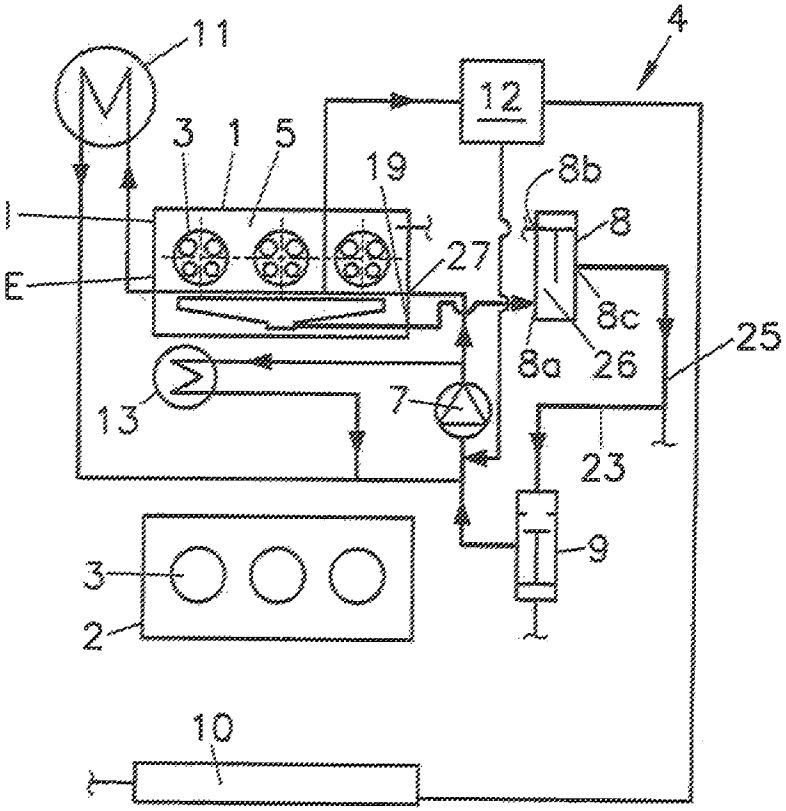
FIG. 12 shows the cooling system of FIG. 11 in a first switching position.

FIGS. 12 and 13 show a first switching position of the cooling system 4 for the second embodiment, wherein the first valve 8 and the second valve 9 are each situated in the first valve position, wherein the first valve positions are associated with the cold internal combustion engine or the cold cooling liquid. The coolant flows from the coolant pump 7 to the distributor chamber 16 and further into the first cooling jacket 5 of the cylinder head 1, with the coolant flowing through the same in the transverse direction. The coolant then moves through the cooling ports 18 into the collecting chamber 14*b* which is also arranged in the cylinder head 1. Since the flow connection between the second valve inlet 8*b* and the valve outlet 8*c* is blocked by the first valve 8, the discharge from the second cooling jacket 6 of the cylinder block 2 is prevented and thus a transfer of the coolant from the first cooling jacket 5 to the second cooling jacket 6 is prevented. The entire coolant of the first cooling jacket 5 reaches the first coolant outlet 19 of the cylinder head 1 from the collecting chamber 14*b*, which outlet is connected to the first valve inlet 8*a* of the first valve. Since the flow connection between the first valve inlet 8*a* and the valve outlet 8*c* within the first valve 8 is opened and the discharge from the radiator 10 is blocked by the first valve position of the second valve 9, coolant flowing out of the first cooling jacket 5 flows through the short return section 23 back to the coolant pump 7.

Figure 15:
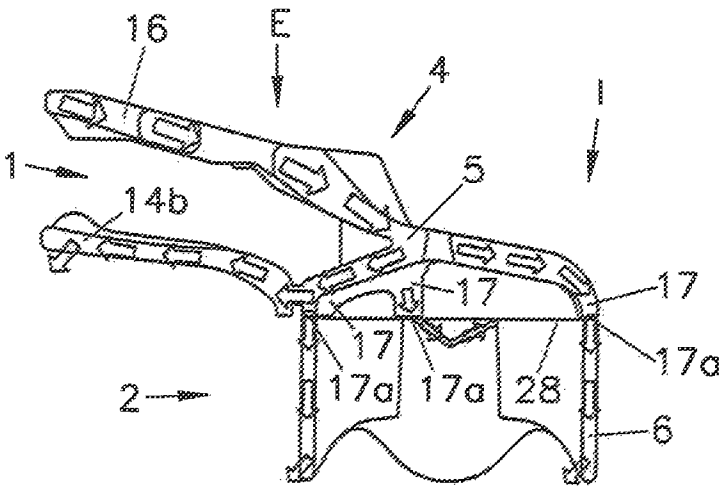
FIG. 15 shows the coolant flow in the second switching position in a cross-sectional view through the cooling jackets.
Figure 14:
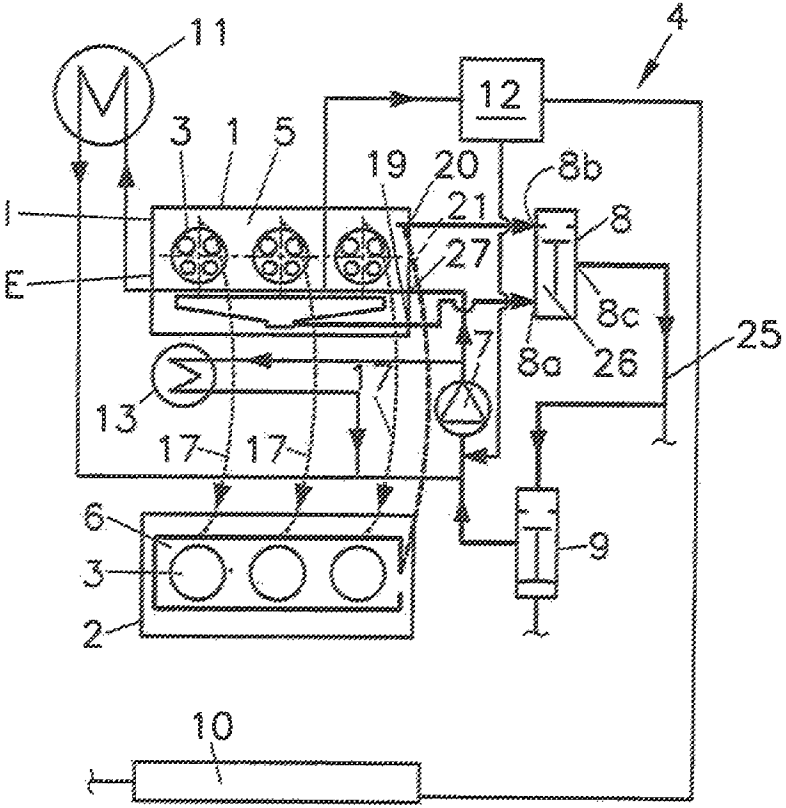
FIG. 14 shows the cooling system of FIG. 11 in a second switching position.

Once the coolant has exceeded a first switching temperature for the first thermostat valve 8, the first valve 8 is switched to the second valve position, as shown in FIG. 14. In this position, both the flow connection between the first valve inlet 8*a* and the valve outlet 8*c* of the first valve 8 as well as the flow connection between the second valve inlet 8*b* and the valve outlet 8*c* is released. A portion of the coolant thus flows from the first cooling jacket 5 of the cylinder head 1 via the connecting flow paths 17 to the second cooling jacket 6 and reaches from said jacket via the riser duct 21 to the second coolant outlet 20 of the cylinder head 1. After the merger of the partial coolant flows originating from the first cooling jacket 5 and the second cooling jacket 6 in the mixing chamber 26 of the first valve 8, the coolant is returned via the short return section 23 to the coolant pump 7. FIG. 15 shows the flow between the distributor chamber 16 and the second cooling jacket 6 or collecting chamber 14*b* for this second switching position of the cooling system 4.

Figure 17:
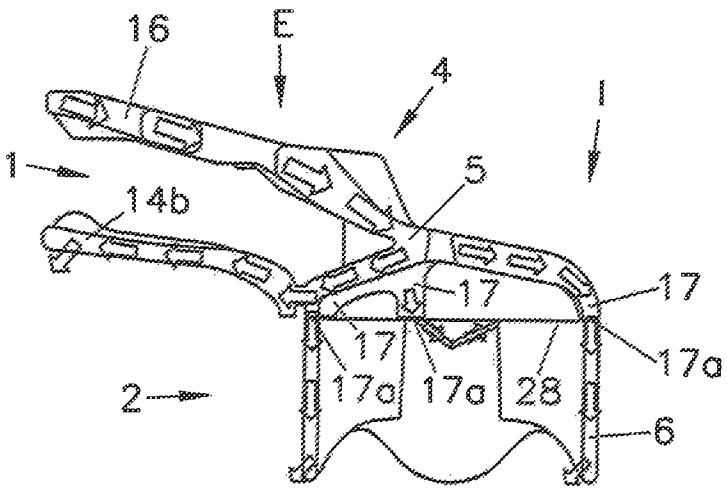
FIG. 17 shows the coolant flow of the third switching position in a cross-sectional view through the cooling jackets.
Figure 16:
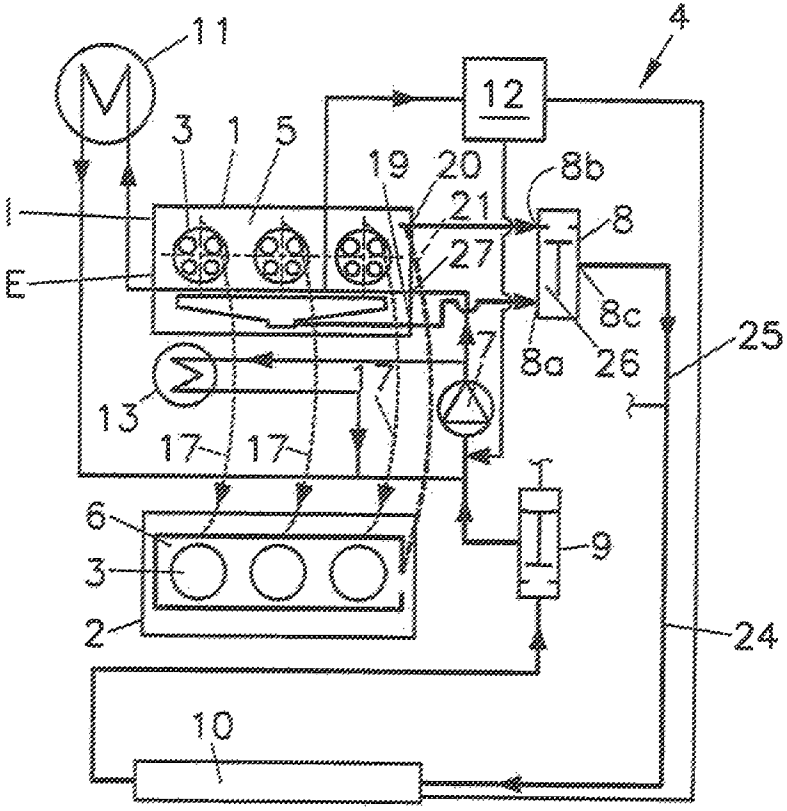
FIG. 16 shows the cooling system of FIG. 11 in a third switching position.

If the internal combustion engine and thus the coolant are heated further, the second valve 9 switches to the second valve position from a second switching temperature, which is shown in FIG. 16. The short return section 23 is thus blocked and the discharge from the radiator 10 to the coolant pump 7 is released. The coolant leaving the first valve 8 now flows through the radiator 10 via the long return section 24 and reaches the coolant pump 7 after passing the second valve 9. The flow through the first cooling jacket 5 and the second cooling jacket 6 as shown in FIG. 17 occurs in an analogous manner to FIG. 14 and FIG. 15.

Figure 18:
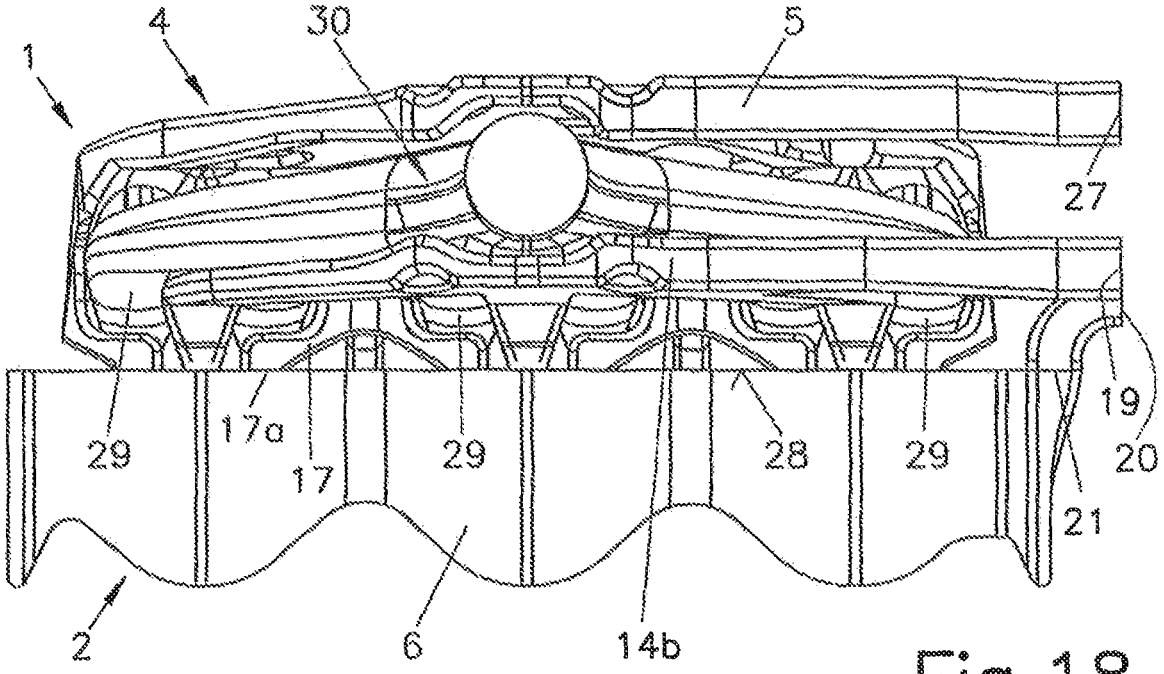
FIG. 18 shows the cooling system of FIG. 11 in a side view.

The second embodiment with the collecting chamber 14*b* arranged between at least one exhaust duct 29 and the cylinder-head sealing surface 28 of the cylinder head 1 offers the advantage that the coolant volume of the cooling system 4 can be arranged in a very small way, and that on the other hand especially high heat dissipation from the region of the exhaust ducts 29 is enabled, especially when the exhaust manifold 30 is integrated in the cylinder head 1, as shown in FIG. 18. This has an especially advantageous effect on the heating-up duration of the coolant during cold starting of the internal combustion engine.

The invention claimed is:

1. A cooling system for an internal combustion engine that extends in longitudinal and transverse directions, comprising:

at least one cylinder head which is connected to at least one cylinder block by means of at least one cylinder-head sealing surface, at least one first cooling jacket arranged in the cylinder head which has a flow connection with at least one coolant inlet and at least one first coolant outlet, and at least one second cooling jacket arranged in the cylinder block which is connected to at least one second coolant outlet, wherein the first and the second cooling jacket are connected to each other by means of at least one connection flow path, and a liquid coolant flows through the first cooling jacket and into the second cooling jacket via a first connecting flow path and, wherein the coolant flow through the second cooling jacket can be controlled by means of at least one first valve which blocks the coolant flow through the second cooling jacket in a first valve position and allows coolant flow in at least one second valve position, wherein the flow through the first cooling jacket can occur in the transverse direction of the internal combustion engine, and wherein at least one collecting chamber extending substantially in the longitudinal direction of the internal combustion engine is arranged in a second connection flow path between the first cooling jacket and the first coolant outlet, the first connection flow path further extending from the second cooling jacket to the at least one second coolant outlet of the cylinder head via a rise duct;

wherein a mixing chamber of the first valve comprises a first and a second valve inlet as well as a valve outlet, and the at least one first coolant outlet of the cylinder head is flow-connected to the first valve inlet, the at least one second coolant outlet to the second valve inlet, and the valve outlet to at least one return line of the cooling system; and wherein only the flow connection between the second valve inlet and the valve outlet is switchable by the first valve.

2. The cooling system according to claim 1, wherein the first coolant outlet of the cylinder head is in continuous flow connection with at least one return line of the cooling system.

3. The cooling system according to claim 2, wherein the return line comprises a long return section with at least one radiator and a short return section which bypasses the radiator, and including a second valve for controlling coolant flow through the short or long return sections.

4. The cooling system according to claim 3, wherein the second valve comprises a thermostat valve.

5. The cooling system according to claim 1, wherein the at least one second coolant outlet of the cylinder head is switchably connected via the first valve to a return line of the cooling system.

6. The cooling system according to claim 5, wherein the return line comprises a long return section with at least one radiator and a short return section which bypasses the radiator, and including a second valve for controlling coolant flow through the short or long return sections.

7. The cooling system according to claim 6, wherein the second valve comprises a thermostat valve.

8. The cooling system according to claim 1, wherein a coolant pump of the cooling system is driven by a camshaft.

9. The cooling system according to claim 8, wherein the camshaft is arranged in the cylinder head.

10. The cooling system according to claim 1, wherein the at least one coolant inlet and/or the at least one first coolant outlet and/or the at least one second coolant outlet are arranged in the cylinder head.

11. The cooling system according to claim 1, wherein the at least one connection flow path extends through an opening in the cylinder-head sealing surface.

12. The cooling system according to claim 1, wherein the first valve comprises a thermostat valve.

13. The cooling system according to claim 1, wherein the flow through the second cooling jacket can occur in the transverse direction of the internal combustion engine.

14. The cooling system according to claim 1, wherein the at least one collecting chamber is arranged in the cylinder block.

15. The cooling system according to claim 1, wherein the at least one collecting chamber is arranged in the cylinder head.

16. The cooling system according to claim 15, wherein the at least one collecting chamber is arranged between at least one exhaust duct and/or an exhaust manifold integrated in the cylinder head, and the cylinder-head sealing surface of the cylinder head.

17. The cooling system according to claim 1, wherein a distributor chamber extending substantially in the longitudinal direction of the internal combustion engine is arranged in the flow path between the coolant inlet and the first cooling jacket.

18. The cooling system according to claim 1, wherein at least one second connecting flow path bypasses the cylinder block by flowing from the at least one first cooling jacket arranged in the cylinder head directly to a second collecting chamber within the cylinder block via one or more collecting ports which return the flow back to the cylinder head.

19. The cooling system according to claim 1, wherein the at least one collecting chamber includes three sections including stepped increases in at least one of depth or volume of the flow path as the at least one collecting chamber extends substantially in the longitudinal direction of the internal combustion engine.

* * * * *